United States Patent [19]

Dowdeswell

[11] Patent Number: 4,936,804

[45] Date of Patent: Jun. 26, 1990

[54] NON-INFLATABLE BUOYANCY AID

[76] Inventor: M. Richard Dowdeswell, 356 Pimlico Rd., Greenville, S.C. 29607

[21] Appl. No.: 281,621

[22] Filed: Dec. 9, 1988

[51] Int. Cl.[5] ..... B63C 9/08

[52] U.S. Cl. ..... 441/6; 441/23; 441/122; 441/129

[58] Field of Search ..... 441/122, 123, 125, 129, 441/55, 59, 60, 6, 23

[56] References Cited

U.S. PATENT DOCUMENTS

| | | | |
|---|---|---|---|
| 2,977,608 | 4/1961 | Brown, Sr. et al. | 441/6 |
| 3,727,252 | 4/1973 | Bauermeister | 441/122 |
| 4,538,998 | 9/1985 | Hölzel | 441/122 |
| 4,804,326 | 2/1989 | Lennon | 441/59 |

FOREIGN PATENT DOCUMENTS

| | | | |
|---|---|---|---|
| 273548 | 4/1964 | Australia | 441/123 |
| 1090498 | 3/1955 | France | 441/122 |
| 1419782 | 10/1965 | France | 441/122 |

*Primary Examiner*—Sherman D. Basinger
*Attorney, Agent, or Firm*—Bailey & Hardaway

[57] ABSTRACT

A non-inflatable buoyancy aid is described comprising an annular structure of closed cell plastic foam which is held in position about a wearer's arms and legs through positive displacement and material friction. The buoyancy aid maintains the wearer in either a horizontal or vertical position at water level, depending upon the positioning of the aid about the limbs.

5 Claims, 2 Drawing Sheets

NON-INFLATABLE BUOYANCY AID

BACKGROUND OF THE INVENTION

This invention relates generally to the art of water recreation and/or water therapy and more specifically to the art of buoyancy devices designed to embrace the limbs of a person's body.

A variety of buoyancy devices have heretofore been constructed to support the body in water and to maintain the body afloat without difficulty. One such device is the life preserver, the intended purpose of which is to keep people from drowning. Disclosed in U.S. Pat. No. 3,750,205 to Pfeifer is a life preserver, either of inflatable construction or made of material lighter than water, which is placed over the head to prevent the head from slipping below water level. In U.S. Pat. No. 3,048,860 to Richardson, the life preserver disclosed is also worn over the head, is of inflatable construction, and includes a mouthpiece for reinflation purposes.

Other more traditional life rings disclosed in U.S. Pat. Nos. 4,059,859 to Hull and 3,050,754 to Le Blanc describe floating annular structures with associated ropes for grasping and retaining the device even in rough water. In U.S. Pat. No. 634,445 to De Wilde the life ring is made up of multiple component parts strung together to form a buoyant collar.

Buoyancy devices also include variously constructed supports for a person learning to swim. An inflatable sleeve to aid flotation is described in U.S. Pat. No. 1,611,427 to Evans which hugs the limbs while promoting the swimming efforts of the wearer. In addition, French Patent No. 1,419,782 to Garrigues discloses a structure of cuffs at the wearer's ankles and wrists connected to an inflated member positioned on the wearer's back. This device also serves to assist the wearer who is learning to swim.

A floatable toy ring for water play is disclosed in U.S. Patent No. 1,593,453 to Hinsen, and the particular design of an inflatable float is claimed in U.S. Pat. No. 169,631 to Norman and Billig.

SUMMARY OF THE INVENTION

It is thus an object of this invention to provide a novel noninflatable flotation device to be selectively positioned about the wearer's arms and legs.

It is a further object of this invention to provide a novel non-inflatable flotation device for use at times of recreation and/or relaxation in the water, for use by persons undergoing in- the-water physical therapy, and/or for use when performing in-the-water repair or maintenance tasks.

It is still a further object of this invention to provide a novel non-inflatable floatation device which is able to maintain the wearer's body at the surface of the water in either a vertical or a horizontal position.

These as well as other objects are accomplished by a noninflatable buoyancy aid comprising an annular structure made from closed cell plastic foam which is held in position about the wearer's arms and legs through positive displacement and material friction.

DETAILED DESCRIPTION

Figure 1:
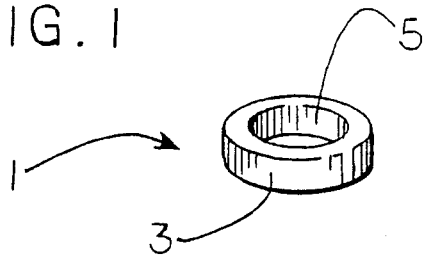
FIG. 1 of the drawings is a perspective view illustrating the non-inflatable buoyancy aid in accordance with this invention.

In accordance with this invention, it has been found that the buoyancy aid described herein can be positioned on the wearer, typically about each leg and arm, to maintain the wearer's body afloat with the head above water level. It has been found in accordance with this invention that the buoyancy aid described herein maintains the wearer's body afloat while the wearer is snorkeling at the surface of the water in a face-down position. Even in combination with a snorkel tube, face mask and swim fins, however, the wearer of the buoyancy aid is unrestricted in movement through the water. The buoyancy aid easily slips into the desired position on a limb because of its loose fit thereon. Yet there is very little slippage once positioned, even in rough water, because it is readily held in place through positive displacement and material friction.

The buoyancy aid is non-inflatable and is constructed of a semi-rigid formulation of light-weight closed cell plastic foam which floats, such as expanded or cross-linked polyethylene foam, neoprene foam and/or PVC foam. The aid is of unit construction and can be molded as an annular structure or formed from sheets of closed cell plastic foam cut into strips. The strips are then bent into circular shape and glued end to end, secured without fastenings or binders, to form an annular structure. One alternative embodiment of the structure has a roughened or jagged inner surface which provides increased ability to grip the wearer's limb. Such embodiment is used particularly when wearing a slick fabric such as a nylon body suit for warmth during recreational swimming.

The annular structure is made in both adult and youth sizes, each size comprising a smaller ring to be worn on the arm and a larger ring to be worn on the leg. The smaller ring is nested inside the larger ring for purposes of efficient packaging when distributed and stored. Due to the cellular structure of the plastic material, the apparatus is very resilient, inert to many common chemicals, and it readily withstands the hazards of exposure to the environment. Its particular cellular structure allows it to remain cool and therefore comfortable to the wearer, and it is easy to keep clean.

The buoyancy aid described herein is capable of supporting the body of the wearer afloat at the surface of the water in either a vertical or horizontal position, depending upon the placement of the rings on the limbs and the intended tilt of the body in the water. The head remains above the water and normal breathing is easily maintained except in the case of intended face-down activity, such as snorkeling. In addition, there is minimal hindrance to the arms and legs of the wearer of the buoyancy aid so that mobility in the water is not impeded. The buoyancy aid is ideal for use in the calm waters of lakes and/or pools for the purposes of recreation or relaxation and for use when performing in-the-water boat or dock maintenance or repair tasks. Further, the worn buoyancy aid is of particular importance to people undergoing in-the-water physical therapy. Many such people lack agility and/or mobility, and the apparatus of this invention provides the necessary support to allow their limbs to be more easily exercised.

The buoyancy aid is intended to be used by swimmers as an assist in staying afloat or by persons undergoing physical therapy under the supervision of an attendant. It is not intended to be used as a personal safety floatation device (life buoy) or by non-swimmers or very young children.

In addition to the applications discussed above, the apparatus of the instant invention lends itself to other water-related uses, including that of a float marker in, for example, racing and SCUBA diving. Such uses would require the apparatus to be secured in place by means of a simple anchor line. These as well as other advantages and features of novelty which characterize the invention will be apparent from the following description and reference to the figures of drawings.

Figure 2:
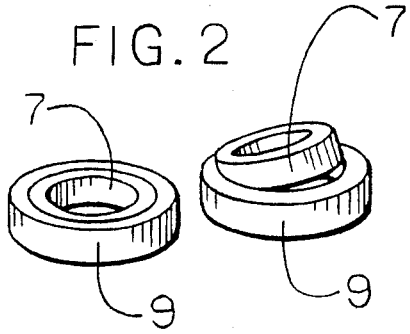
FIG. 2 of the drawings is a perspective view showing a complete set of buoyancy aids in accordance with this invention nested for efficient packaging.

FIG. 1 of the drawings illustrates the buoyancy aid 1 including annular structure 3 defining open-ended chamber 5 for receiving the wearer's arm or leg, specific arrangements of which are illustrated in FIGS. 3, 4, 5, 6 and 7. In FIG. 2 of the drawings, annular structure 7 for the wearer's arm is shown nested inside annular structure 9 for the wearer's leg, an arrangement which promotes effective packaging and shipment.

Figure 3:
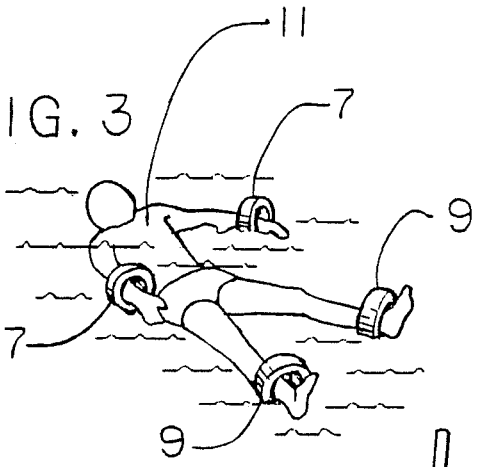
FIG. 3 of the drawings is an elevated perspective view of a wearer maintained horizontally on the back in water by the non-inflatable buoyancy aid in accordance with this invention positioned at wrists and ankles.
Figure 4:
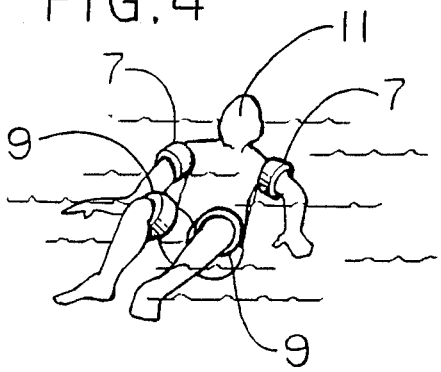
FIG. 4 of the drawings illustrates a wearer maintained horizontally on the back in water while supported by the non-inflatable buoyancy aid in accordance with this invention positioned at shoulders and knees.
Figure 5:
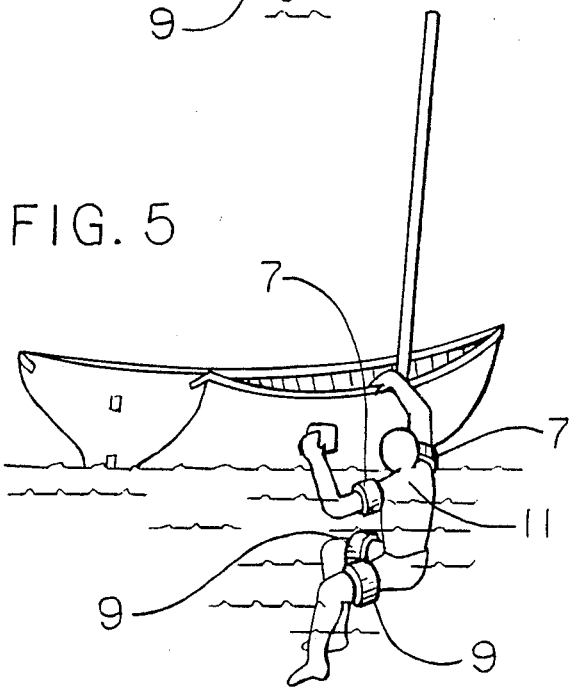
FIG. 5 of the drawings illustrates a wearer of the buoyancy aid in accordance with this invention maintained vertically in water while cleaning a boat, supported at thighs and upper arms or shoulders.
Figure 6:
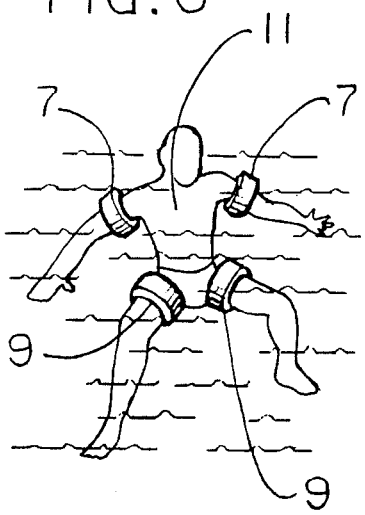
FIG. 6 of the drawings illustrates a wearer maintained vertically or in a sitting position in the water by the non-inflatable buoyancy aid in accordance with this invention positioned at thighs and shoulders.

Illustrated in FIG. 3 is a wearer 11 of the buoyancy aid maintained horizontally on the back by annular structure 7 positioned about the arms at the wrists and annular structure 9 positioned about the legs at the ankles. Similarly, FIG. 4 shows wearer 11 maintained horizontally on the back by annular structure 7 positioned about the arms at the shoulders, and annular structure 9 positioned about the legs at the thighs. Both FIG. 5 and FIG. 6 illustrate a wearer 11 maintained vertically in the water while supported by annular structure 7 positioned about the arms at the shoulders and by annular structure 9 positioned about the legs at the thighs.

Figure 7:
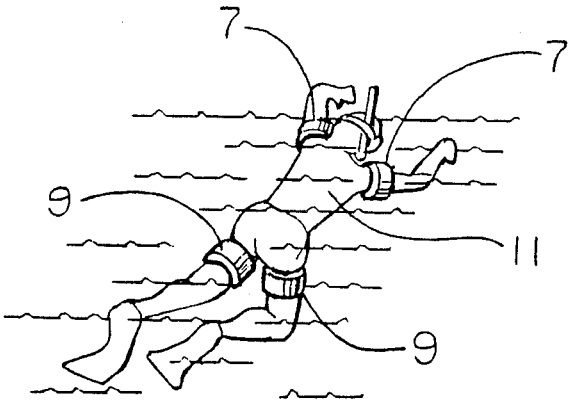
FIG. 7 of the drawings shows a wearer maintained horizontally on the stomach in the water by the non-inflatable buoyancy aid in accordance with this invention positioned at thighs and shoulders while breathing through a snorkel tube.

A illustrated in FIG. 7 if the drawings, wearer 11 can snorkel at water level in a face-down position being maintained at that position by annular structure 7 about the arms at the shoulders and annular structure 9 about the legs at the thighs. The snorkeling activity is unencumbered by the use of the device of this invention.

Figure 8:
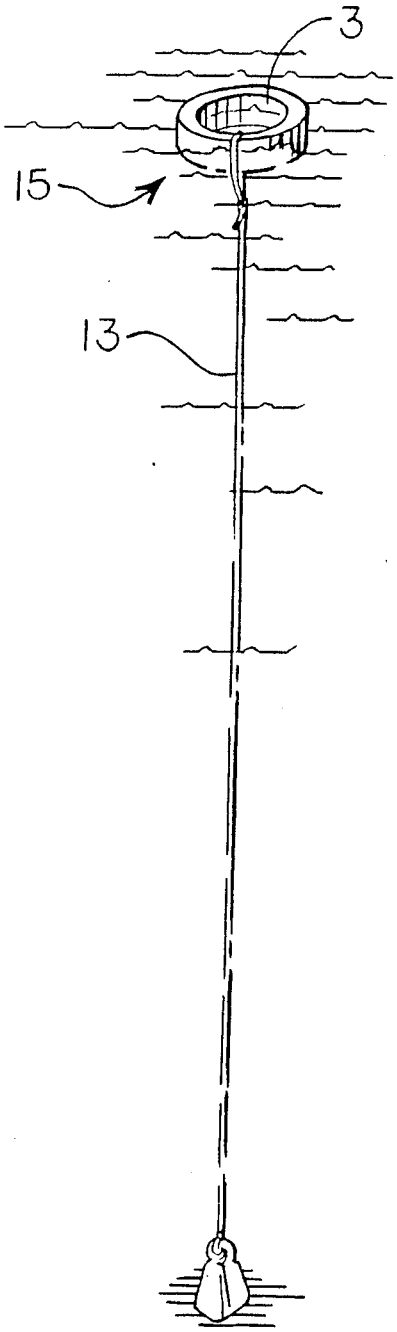
FIG. 8 of the drawings is a side perspective view which illustrates an alternative embodiment with an anchor line as a float marker.
Figure 9:
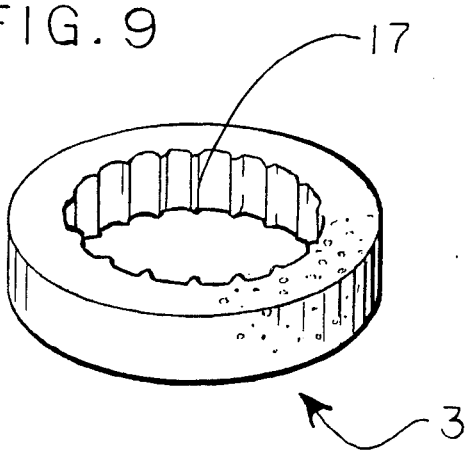
FIG. 9 of the drawings is a top perspective view illustrating alternative embodiment of the invention in accordance with this invention which has a roughened interior surface.

In FIG. 8, an alternative embodiment of the apparatus of the instant invention is shown. Annular structure 3 is used in combination with anchor line 13 as a float marker 15 in, for example, sail racing and SCUBA diving. Another alternative embodiment of the buoyancy aid is shown in FIG. 9 where the inner surface 17 of annular structure 3 is roughened or jagged for greater adherence about the wearer's limb. Such embodiment is particularly appropriate if a body suit of slick material is worn between the buoyancy aid and the wearer's limb.

It is thus seen that the buoyancy aid described herein is a novel and effective means for keeping the wearer's body afloat, in either a horizontal or vertical position, without difficulty. Particular uses of the apparatus of this invention are many and varied, including in-the-water recreation, relaxation, physical therapy and boat or dock repair and maintenance work. As variations of the instant invention will be apparent to one of skill in the art from a reading of the above specifications, such variations are within the spirit and scope of this invention as defined by the following appended claims.

What is claimed is:

1. A non-inflatable buoyancy aid comprising:

an annular structure of closed cell plastic foam for placement on the arm of a wearer;

an annular structure of closed cell plastic foam for placement on the leg of a wearer;

each said annular structure having an inside cylindrical wall and an outside cylindrical wall parallel to said inside cylindrical wall and displaced therefrom about a radius of said annular structure, said inside cylindrical wall and said outside cylindrical wall connected by transverse end walls at either end of thereof;

said transverse end walls being substantially perpendicular to said inside cylindrical wall and said outside cylindrical wall;

said buoyancy aid capable of supporting a wearer by placement on the wearer's arm and leg through displacement of an aqueous substance and frictional engagement with wearer;

said annular structure placed on the arm of a wearer of a size enabling it to be nested within said annular structure placed on the leg of a wearer.

2. The non-inflatable buoyancy aid in accordance with claim 1 wherein said annular structures are of unit construction.

3. The non-inflatable buoyancy aid in accordance with claim 1 wherein said annular structure for the wearer's arm nests within said annular structure for the wearer's leg for purposes of packaging.

4. The non-inflatable buoyancy aid in accordance with claim 1 wherein one of said annular structure, in combination with an anchor line, is used as a float marker.

5. The non-inflatable buoyancy aid in accordance with claim 1 wherein each said annular structure has a roughened or jagged interior surface.

* * * * *